US012241251B2

(12) United States Patent
Killian et al.

(10) Patent No.: US 12,241,251 B2
(45) Date of Patent: Mar. 4, 2025

(54) SPACER FOR ROOF AND ROOF COMPRISING SAME

(71) Applicants: James Killian, Rockport, MA (US); David Furman, Johnstown, PA (US)

(72) Inventors: James Killian, Rockport, MA (US); David Furman, Johnstown, PA (US)

( * ) Notice: Subject to any disclaimer, the term of this patent is extended or adjusted under 35 U.S.C. 154(b) by 272 days.

(21) Appl. No.: 17/896,430

(22) Filed: Aug. 26, 2022

(65) Prior Publication Data

US 2024/0068236 A1 Feb. 29, 2024

(51) Int. Cl.

| | |
|---|---|
| ***E04H 12/20*** | (2006.01) |
| ***E04D 3/36*** | (2006.01) |
| ***E04D 13/17*** | (2006.01) |
| *E04D 3/16* | (2006.01) |

(52) U.S. Cl.
CPC ..... *E04D 3/36* (2013.01); *E04D 13/17* (2013.01); *E04D 3/16* (2013.01)

(58) Field of Classification Search
CPC ..... E04D 3/36; E04D 13/17
See application file for complete search history.

(56) References Cited

U.S. PATENT DOCUMENTS

| | | | | |
|---|---|---|---|---|
| 1,582,281 A | | 4/1926 | Kridler et al. | |
| 3,397,496 A | * | 8/1968 | Sohns | E04C 2/292 52/286 |
| 4,031,683 A | * | 6/1977 | Walker | E04D 3/30 D25/140 |
| 5,020,293 A | * | 6/1991 | Itagaki | E04F 13/0835 248/223.41 |
| 5,761,864 A | | 6/1998 | Nonoshita | |
| 5,826,390 A | | 10/1998 | Sacks | |
| 6,023,922 A | | 5/2000 | Lancaster | |
| 6,357,193 B1 | | 3/2002 | Morris | |
| 6,938,383 B2 | | 9/2005 | Morris et al. | |

(Continued)

FOREIGN PATENT DOCUMENTS

| | | |
|---|---|---|
| CA | 2067683 C | 3/1994 |
| WO | WO 2007/109846 | 10/2007 |

OTHER PUBLICATIONS

Quarrix Protect Furring Strips, https://www.roofingdirect.com/shop/quarrix-furring-strips, Accessed Jul. 17, 2022.

(Continued)

*Primary Examiner* — Basil S Katcheves
(74) *Attorney, Agent, or Firm* — Ballard Spahr LLP

(57) ABSTRACT

A spacer has an elongated body having a first end and a second end that are spaced along a longitudinal axis. The elongated body has a first side and an opposed second side that are spaced along a transverse axis that is perpendicular to the longitudinal axis and a third side and an opposed fourth side that are spaced along a thickness axis that is perpendicular to the longitudinal axis and the transverse axis. At least one channel extends into the elongated body from the third side of the elongated body and toward the fourth side of the elongated body. The at least one channel extends along the transverse axis from the first side to the second side of the elongated body. Each channel has opposed ends each having a width, and a neck between the opposed ends. The neck is narrower than the width of each of the opposed ends.

20 Claims, 8 Drawing Sheets

(56) References Cited

U.S. PATENT DOCUMENTS

| | | | | |
|---|---|---|---|---|
| 7,247,090 | B2 | 7/2007 | Vacek | |
| 8,769,894 | B2 | 7/2014 | Power et al. | |
| 9,676,165 | B2 * | 6/2017 | Van Wey | B32B 3/04 |
| 10,378,213 | B2 | 8/2019 | Hill et al. | |
| 10,480,188 | B2 | 11/2019 | Power | |
| 10,876,304 | B2 * | 12/2020 | Shaw | E04F 13/08 |
| 2009/0025327 | A1 | 1/2009 | Albracht | |
| 2014/0305063 | A1 * | 10/2014 | Kim | E04F 13/0814 52/745.1 |
| 2014/0311070 | A1 * | 10/2014 | Pollack | D04H 1/55 52/302.1 |
| 2015/0096248 | A1 * | 4/2015 | Tebo | E04F 13/007 52/302.3 |
| 2018/0127983 | A1 * | 5/2018 | Roy | E04D 12/004 |
| 2019/0249419 | A1 | 8/2019 | Gonzales et al. | |

OTHER PUBLICATIONS

Furring Strips of the Future, https://www.keenebuilding.com/news-and-blog/thedriguy/october-2020-1/furring-strips-of-the-future, Keene Building Products, Published Oct. 2020.

* cited by examiner

SPACER FOR ROOF AND ROOF COMPRISING SAME

FIELD

This application relates to devices for providing a roof, such as, for example, a sheet metal roof.

BACKGROUND

Sheet metal roofs are growing in popularity for their value, aesthetics, and durability. To enhance cost savings and the speed of the installation, sheet metal roofs are normally installed on top of existing roofing materials, such as, for example, shingles. The installation typically involves the use of thin wooden purlins (laterally extending members) that are positioned horizontally directly on top of the existing roof surface. The sheet metal roofing material is then secured on top of the purlins. Over time, it is common for moisture to collect in the gap between the original roofing material and the underside of the metal roofing, which leads to rotting of the purlin and underside rusting of the sheet metal. Accordingly, a way to provide an installation that creates a natural ventilation of the gap is desirable.

SUMMARY

Disclosed herein, is a spacer comprising an elongated body having a first end and a second end that are spaced along a longitudinal axis. The elongated body has a first side and an opposed second side that are spaced along a transverse axis that is perpendicular to the longitudinal axis and a third side and an opposed fourth side that are spaced along a thickness axis that is perpendicular to the longitudinal axis and the transverse axis. At least one channel extends into the elongated body from the third side of the elongated body and toward the fourth side of the elongated body. The at least one channel extends along the transverse axis from the first side to the second side of the elongated body. Each channel has opposed ends each having a width, and a neck between the opposed ends. The neck is narrower than the width of each of the opposed ends.

Also disclosed herein is a spacer comprising an elongated body having a first end and a second end that are spaced along a longitudinal axis. The elongated body has a first side and an opposed second side that are spaced along a transverse axis that is perpendicular to the longitudinal axis and a third side and an opposed fourth side that are spaced along a thickness axis that is perpendicular to the longitudinal axis and the transverse axis. At least one channel extends into the elongated body from the third side of the elongated body and toward the fourth side of the elongated body. The at least one channel extends along the transverse axis from the first side to the second side of the elongated body. At least one groove extends into the elongated body from the fourth side of the elongated body and toward the third side of the elongated body. The at least one groove extends along the transverse axis from the first side to the second side of the elongated body.

Also disclosed herein is a roof comprising a spacer comprising an elongated body having a first end and a second end that are spaced along a longitudinal axis. The elongated body has a first side and an opposed second side that are spaced along a transverse axis that is perpendicular to the longitudinal axis and a third side and an opposed fourth side that are spaced along a thickness axis that is perpendicular to the longitudinal axis and the transverse axis. At least one channel extends into the elongated body from the third side of the elongated body and toward the fourth side of the elongated body. The at least one channel extends along the transverse axis from the first side to the second side of the elongated body. A roofing material is coupled to the spacer. In some aspects, at least one groove extends into the elongated body from the fourth side of the elongated body and toward the third side of the elongated body. The at least one groove extends along the transverse axis from the first side to the second side of the elongated body. In some optional aspects, each channel has opposed ends each having a width, and a neck between the opposed ends, and the neck is narrower than the width of each of the opposed ends.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
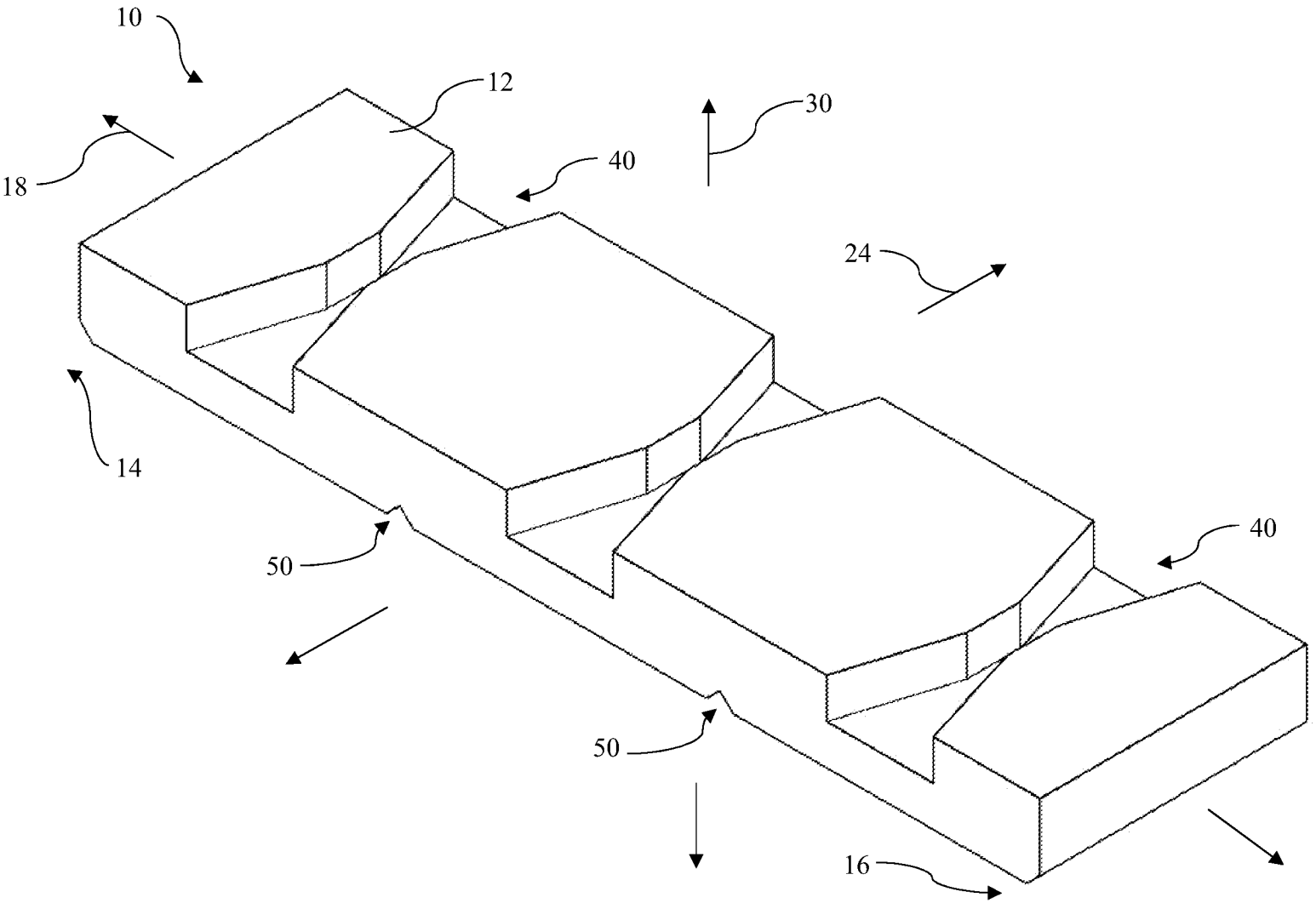
FIG. 1 is a perspective view of a spacer as disclosed herein.
Figure 2:
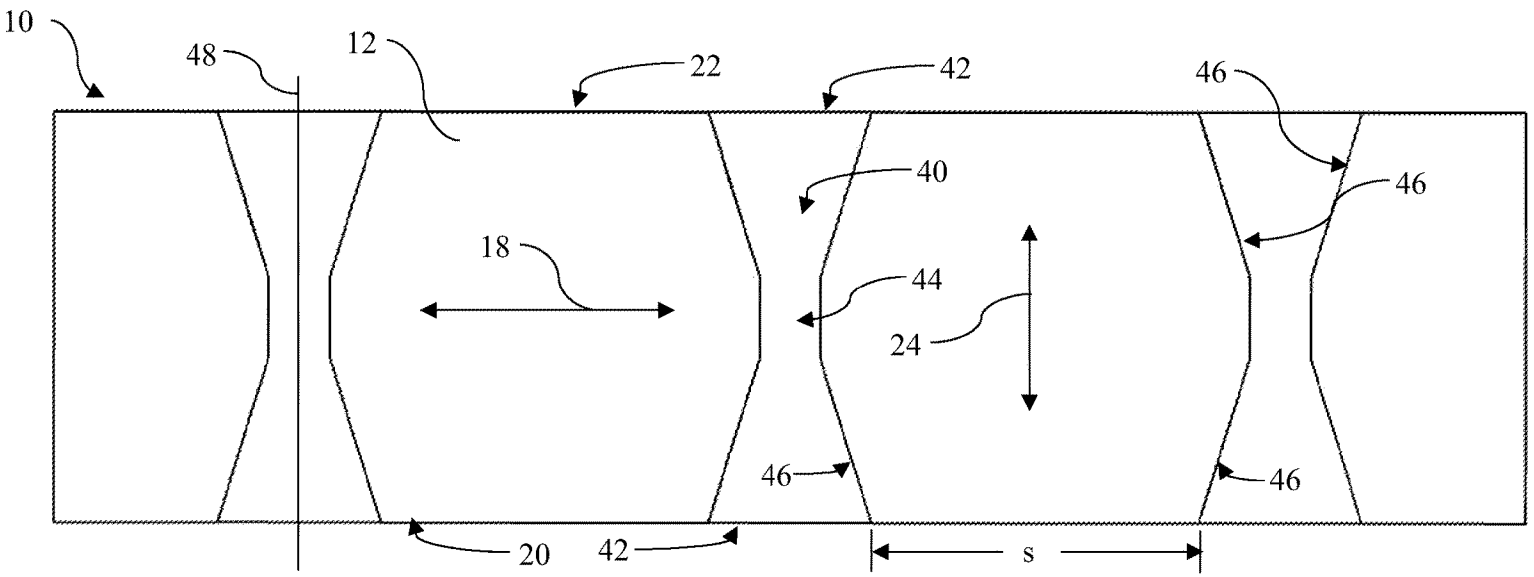
FIG. 2 is a bottom plan of the spacer of FIG. 1.
Figure 3:
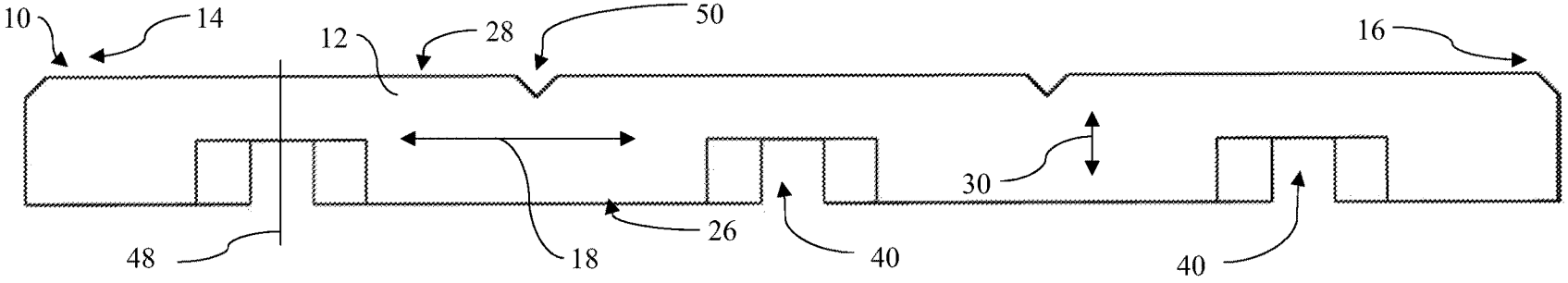
FIG. 3 is a side elevational view of the spacer of FIG. 1.
Figure 4:
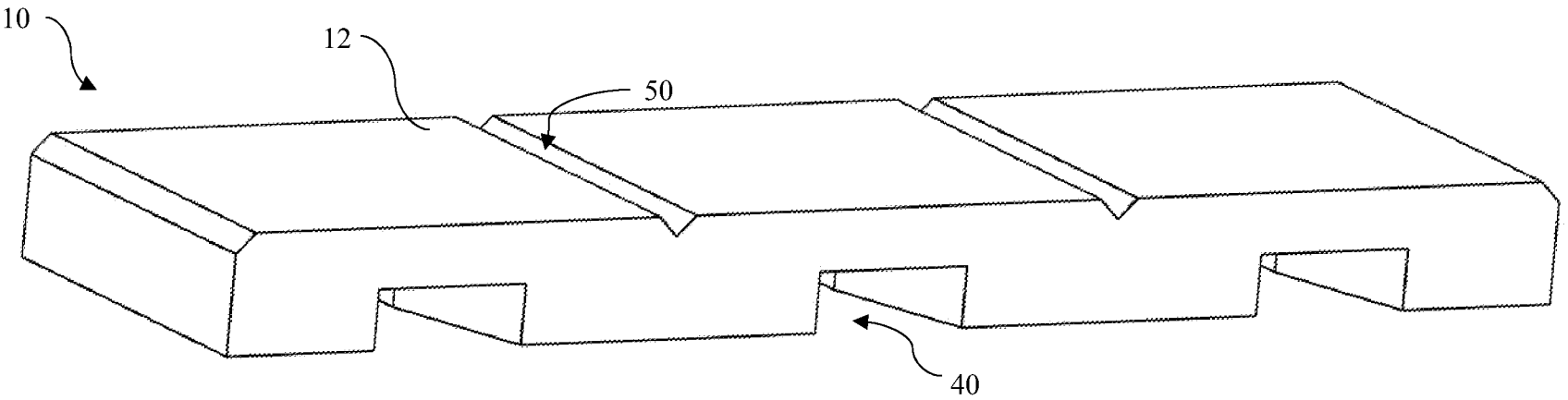
FIG. 4 is another perspective view of the spacer of FIG. 1.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

It must be noted that as used herein and in the appended claims, the singular forms "a," "an," and "the" include plural references unless the context clearly dictates otherwise. Thus, for example, reference to "a channel" includes one or more of such channels, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values or characteristics are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

Disclosed here, in one aspect, and with reference to FIGS. 1-4, is a spacer 10 that can be used with a roof. For example, in some aspects, the spacer 10 can be positioned beneath, and support, a metal roof. In some optional aspects, the spacer 10 can space the metal roof from shingles. The spacer 10 can permit water flow to inhibit collection of water that can cause leaking or water damage. For example, the spacer can comprise one or more channels that permit water to flow under the spacer. Further, the spacer 10 can permit optimal air flow for heat transfer as well as moisture transfer. For example, the same channels can permit airflow to enable heat transfer via convection. Still further, the spacer can optionally comprise grooves that permit air to travel above the spacer to permit further heat transfer via convection. The flow of air can further carry water vapor to inhibit water collection and, thus, water damage.

The spacer 10 can comprise an elongated body 12 having a first end 14 and a second end 16 that are spaced along a longitudinal axis 18. The elongated body 12 can have a first side 20 and an opposed second side 22 that are spaced along a transverse axis 24 that is perpendicular to the longitudinal axis 18 and a third side 26 and an opposed fourth 28 side that are spaced along a thickness axis 30 that is perpendicular to the longitudinal axis 18 and the transverse axis 24.

The spacer 10 can comprise at least one channel 40 that extends into the elongated body 12 from the third side 26 of the elongated body and toward the fourth side 28 of the elongated body. Each channel of the at least one channel 40 can extend along the transverse axis 24 from the first side 20 to the second side 22 of the elongated body 12. In some optional aspects, the spacer 10 can comprise a plurality of channels 40 that are spaced from each other along the longitudinal axis 18.

Each channel 40 of the at least one channel can have opposed ends 42 each having a respective width. Optionally, the respective width of each end of the opposed ends 42 can be equal. In alternative aspects, respective width of each end of the opposed ends 42 can be different. In some aspects, each channel 40 can have a neck 44 between the opposed ends, wherein the neck is narrower than the width of each of the opposed ends. In this way, each channel 40 can have a Venturi shape. The Venturi shape can cause fluid flow (e.g., airflow) therethrough to accelerate at the neck 44, thereby drawing air and moisture through the channel 40. Still further, the Venturi shape can provide relatively wide openings at the opposed ends 42 of the channels 40 in order to permit water flow therethrough while having the increased structural support provided by the narrowed neck 44.

The channels 40 can have side surfaces 46. In some aspects, adjacent side surfaces 46 of adjacent channels 40 at the ends 42 can be spaced by a spacing, s, from about 1 inch to about 8 inches. Optionally, said spacing, s, between side surfaces 46 of adjacent channels 40 can be about 2 inches. In some aspects, spaced center-to-center by about 3 inches, and side surfaces 46 of adjacent channels can be spaced by about 2 inches. Optionally, the respective widths of the opposed ends 42 of the channels 40 can be about half of the spacing s. For example, the spacing s can be from about 1× the respective widths of the opposed ends 42 of the channels to about 4× the respective widths of the opposed ends 42 of the channels. Thus, in some optional aspects, at the first and second sides 20, 22, the channels 40 can extend across about ⅓ of the length of the board at the third side 26 of the elongated body 12. In this way, minimal amounts of water can build up at the lower edge (at the third side 26 of the elongated body 12), and air can flow freely through the spacer.

In alternative embodiments, the channels 40 can have other (non-Venturi) profiles. For example, optionally, the channels 40 can have consistent cross sections in planes perpendicular to the transverse axis 24. In yet further aspects, the channels 40 can have cross sections that taper from the first side 20 to the second side 22.

In some aspects, the spacer 10 can comprise at least one groove 50 that extends into the elongated body 12 from the fourth side 28 of the elongated body and toward the third side 26 of the elongated body 12. The at least one groove 50 can extend along the transverse axis 24 from the first side 20 to the second side 22 of the elongated body 12. The groove(s) 50 can permit airflow between the spacer 10 and roofing material above the spacer. In this way, both moisture and air (e.g., hot air) an efficiently pass by the spacer 10. For example, the grooves 50 can be positioned between the spacer 10 and the roofing material (e.g., sheet metal roofing). The roofing material can generally be subject to condensation forming on a side of the roofing material facing the spacer 10. Heating of air below the roofing material can cause a pressure differential that leads to convective air flow as warmer air rises. Flow between the spacer 10 and the roofing material through the grooves 50 can reduce or eliminate condensation on the side of the roofing material facing the spacer.

In exemplary aspects, the spacer 10 can comprise a plurality of channels 40 and a plurality of grooves 50. In some optional aspects, each groove 50 of the plurality of grooves can be positioned between respective pairs of channels 40 of the plurality of channels. Optionally, the each groove 50 of the plurality of grooves can be centered between the respective pairs of channels.

In exemplary aspects, each groove 50 of the at least one groove can be V-shaped in cross sections perpendicular to the transverse axis 24. In other aspects, the grooves 50 can have any cross sectional shape, including U-shaped or rectangular cross sectional profiles. In some optional aspects, each groove 50 can have a depth along the thickness axis from about 1/16 inch to about 1/4 inch (e.g., about 1/8 inch).

Optionally, the spacer 10 can comprise (or consist of, or consist essentially of) synthetic polymer, such as, for example, polyethylene, polyvinyl chloride. Optionally, the spacer 10 can comprise a composite material. Optionally, the spacer 10 can comprise virgin polymer, recycled polymer, or a combination thereof. In this way, the spacer 10 can be water resistant. In exemplary aspects, the spacer 10 can be manufactured via plastic extrusion. For example, optionally, the spacer 10 can be formed via plastic extrusion on a continuous cycle, cutting at predetermined lengths. In further aspects, the spacer 10 can be manufactured by injection molding and/or by milling/machining.

In some aspects, the elongated body 12 has a thickness along the thickness axis 30. In some aspects, each channel 40 of the at least one channel has a depth along the thickness axis 30 that is about half of the thickness of the elongated body 12. For example, in some aspects, the elongated body 12 can have a thickness of about 1.9 cm (3/4 inch), and the channels 40 can have a depth of about 0.95 cm (3/8 inch).

In some aspects, the width of each of the opposed ends 42 of each channel 40 of the at least one channel is from about 1.3 cm (1/2 inch) to about 5.1 cm (2 inches). For example, optionally, each of the opposed ends 42 can have a width of 2.5 cm (1 inch). In some optional aspects, the width of each of the opposed ends 42 can be equal. Optionally, the neck 44 can have a width that is less than about half of the width of the opposed ends 42. For example, the opposed ends 42 can have a width of about 2.5 cm (1 inch), and the neck 44 can have a width of about 0.95 cm (3/8 inch).

Optionally, each channel 40 of the at least one channel can have a linearly decreasing width between the opposed ends 42 and the neck 44. For example, between the opposed ends 42 and the neck 44, cross sections of side surfaces 46 of the channels 40 in planes perpendicular to the thickness axis 30 can be linear. In some optional aspects, the channels 40 can have rectangular cross sections in planes perpendicular to the transverse axis 24.

In some optional aspects, the neck 44 can have a length along the transverse axis 24. Along the length of the neck 44, the channel 40 can have a constant width. In alternative aspects, the neck 44 can be a closest point between the side surface 46 of the channel 40 along the transverse axis 24.

Optionally, each channel 40 of the at least one channel can be symmetric about a respective plane 48 that bisects the channel and is parallel to the transverse axis 24 and the thickness axis 30. Optionally, the spacer 10 can be symmetric about a plane that bisects the spacer and is parallel to the longitudinal axis 18 and the thickness axis 30. In this way, the spacer can permit non-directional installation thereof. For example, the first and second sides 20, 22 can be the same so that the spacer need not be flipped about the thickness axis 30 to provide proper orientation.

In some aspects, the spacer 10 illustrated in the figures can be only a segment of a spacer. That is, the spacer 10 can comprise a plurality of channels 40 that repeat (at equal or unequal spacing therebetween) across any suitable length. Similarly, the spacer 10 can optionally comprise a plurality of grooves 50 that repeat (at equal or unequal spacing therebetween) across any suitable length. For example, in some aspects, the elongated body 12 can have a length along the longitudinal axis 18 from about 0.3 m (1 foot) to about 6.1 m (20 feet). Optionally, the elongated body can have a length along the longitudinal axis 18 from about 1.2 m (4 feet) to about 4.9 m (16 feet). In optional aspects, the elongated body 12 can have a length along the longitudinal axis 18 from about 2.4 m (8 feet) to about 3.7 m (12 feet). In optional aspects, the elongated body 12 can have a length along the longitudinal axis 18 from about 3.7 m (12 feet) to about 4.9 m (16 feet). Optionally, the elongated body 12 can have a length along the longitudinal axis 18 of about 2.4 m (8 feet). Optionally, the elongated body 12 can have a length along the longitudinal axis 18 of about 3.7 m (12 feet). Optionally, the elongated body 12 can have a length along the longitudinal axis 18 of about 4.9 m (16 feet). Still further, the first and second ends need not be positioned from the most proximate channel 40 at exactly half of the spacing between adjacent channels, as illustrated, although they may.

In further optional aspects, the elongated body 12 can have a width along the transverse axis 24 from about 3.8 cm (1.5 inches) to about 12.7 cm (5 inches). For example, in some aspects, the elongated body 12 can have a width of about 6.4 cm (2.5 inches). In some aspects, the elongated body 12 can have a width along the transverse axis 24 from about 1/2 inch to about 3 inches. In some aspects, the elongated body 12 can have a width along the transverse axis 24 from about 1/2 inch to about 4 inches. In some aspects, the elongated body 12 can have a width along the transverse axis 24 from about 2 inches to about 8 inches. In some aspects, the elongated body 12 can have a width along the transverse axis 24 from about 3 inches to about 8 inches. In some aspects, the elongated body 12 can have a width along the transverse axis 24 from about 4 inches to about 8 inches. In some aspects, the elongated body 12 can have a width along the transverse axis 24 from about 5 inches to about 8 inches. In some aspects, the elongated body 12 can have a width along the transverse axis 24 from about 5 inches to about 8 inches. In some aspects, the elongated body 12 can have a width along the transverse axis 24 from about 2 inches to about 3 inches.

In further optional aspects, the elongated body 12 can have a thickness along the thickness axis 30 from about 1.3 cm (½ inch) to about 5.1 cm (2 inches). For example, in some aspects, the elongated body 12 can have a thickness of about 1.9 cm (¾ inches). In some aspects, the elongated body 12 can have a thickness along the thickness axis 30 from about ½ inch to about 2 inches. In some aspects, the elongated body 12 can have a thickness along the thickness axis 30 from about ½ inch to about 1 inch. In some aspects, the elongated body 12 can have a thickness along the thickness axis 30 from about ¼ inch to about 2 inches. In some aspects, the elongated body 12 can have a thickness along the thickness axis 30 from about 1 inch to about 2 inches. In some aspects, the elongated body 12 can have a thickness along the thickness axis 30 from about ½ inch to about ¾ inch. In some aspects, the elongated body 12 can have a thickness along the thickness axis 30 from about ¾ inch to about 1 inch.

Figure 5:
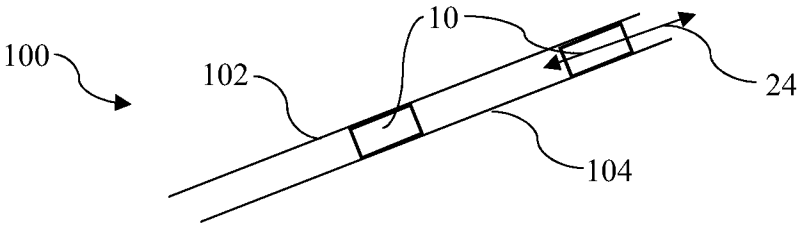
FIG. 5 is a cross section of a portion of a roof comprising a spacer as disclosed herein.
Figure 6:
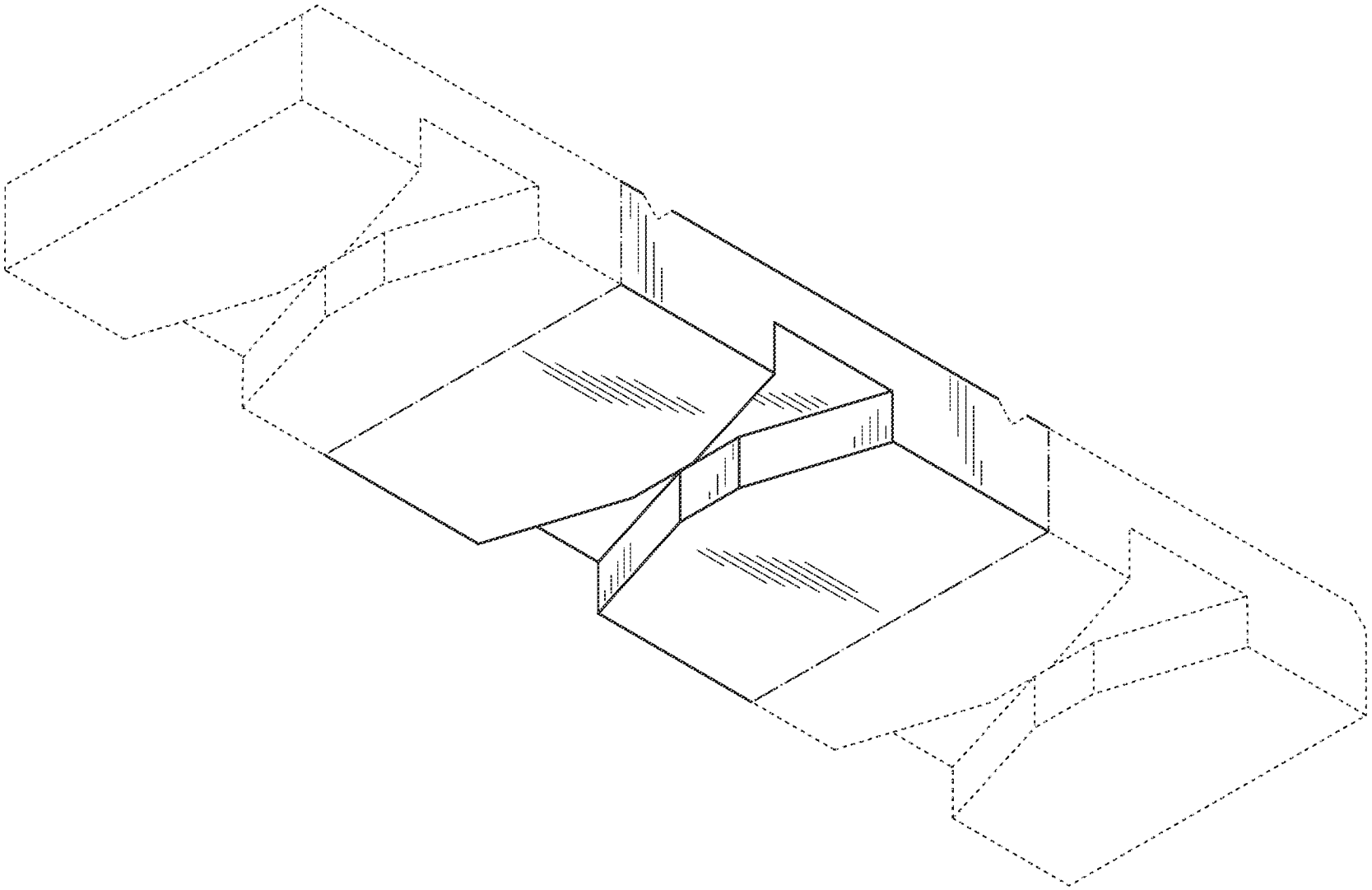
FIG. 6 is a perspective view of a roofing spacer as disclosed herein, showing a channel of the roofing spacer, with portions of the spacer shown in broken lines to indicate portions of the roofing spacer that may or may not constitute an ornamental design of the roofing spacer.
Figure 8:
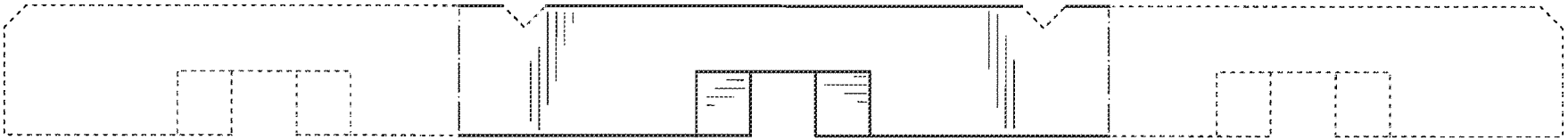
FIG. 8 is a right side elevational view of the roofing spacer of FIG. 6.
Figure 7:
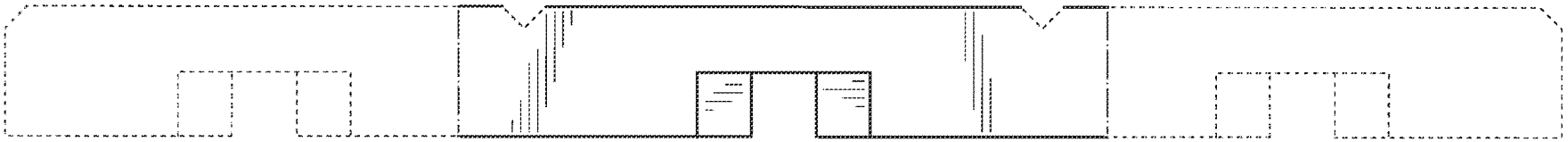
FIG. 7 is a left side elevational view of the roofing spacer of FIG. 6.
Figure 9:
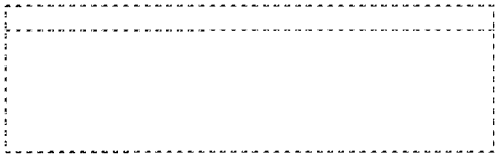
FIG. 9 is a front elevational view of the roofing spacer of FIG. 6.
Figure 10:
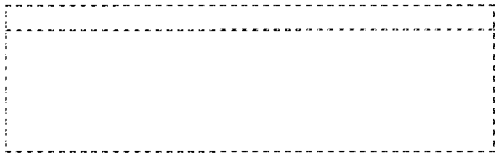
FIG. 10 is a rear elevational view of the roofing spacer of FIG. 6.
Figure 11:
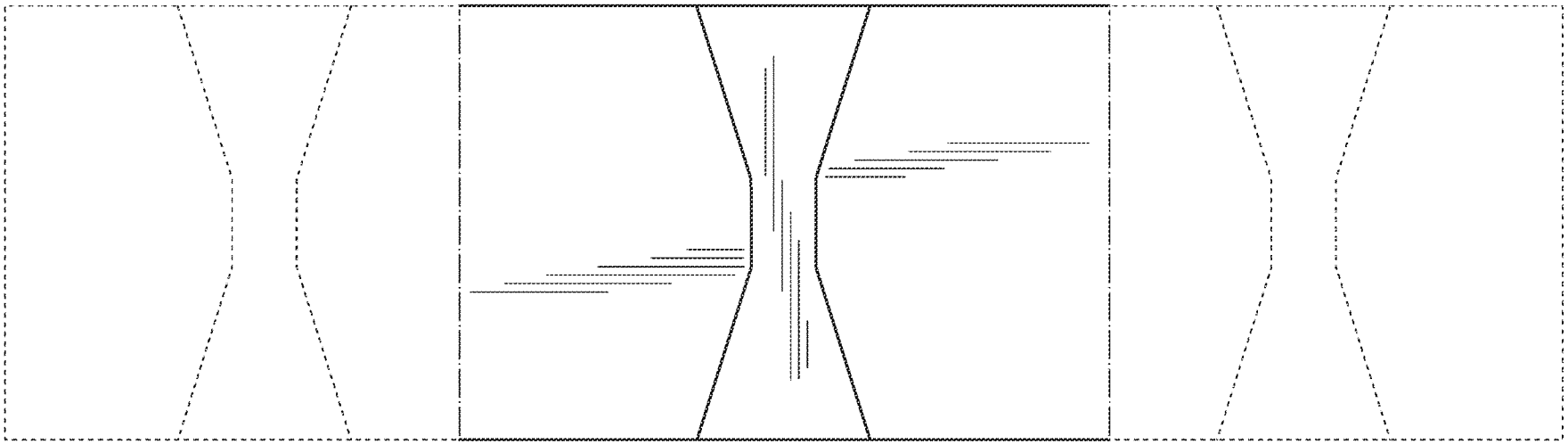
FIG. 11 is a bottom plan view of the roofing spacer of FIG. 6.
Figure 12:
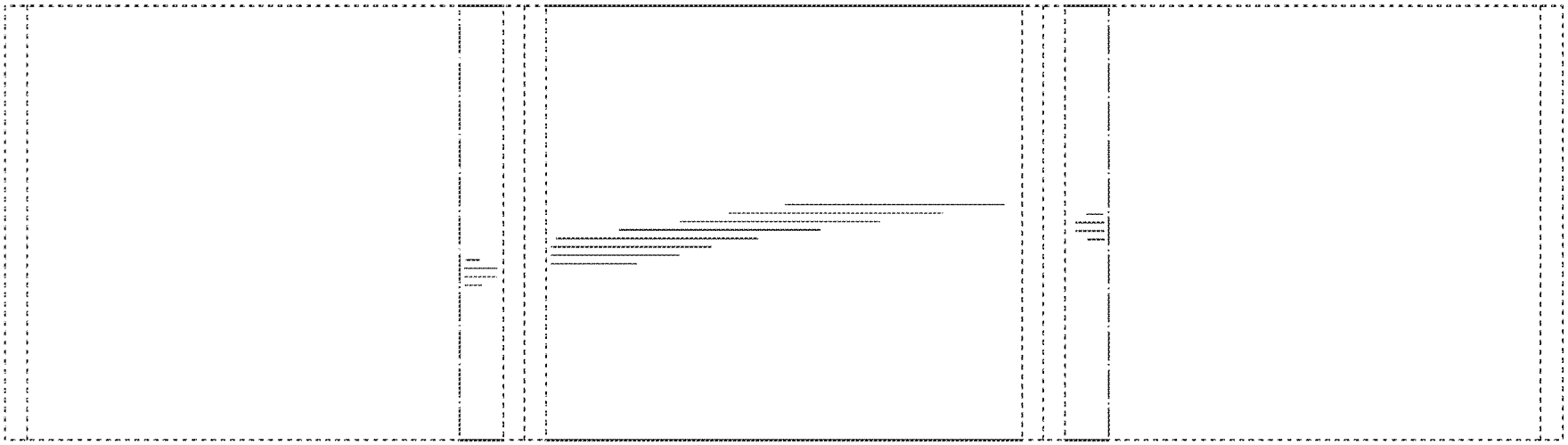
FIG. 12 is a top plan view of the roofing spacer of FIG. 6.

Referring also to FIG. 5, in some aspects, a roof 100 can comprise a spacer 10 as disclosed herein and a roofing material 102 positioned on the fourth side 28 of the spacer. Optionally, the roofing material 102 can be positioned against and in contact with the fourth side 28 of the spacer. In further aspects, the roofing material 102 can be positioned on the side of, but spaced from, the fourth side 28 of the spacer 10 (e.g., with a shim or other spacing element therebetween). The roofing material 102 can optionally comprise metal (e.g., sheet metal). In some aspects, the spacer 10 can be positioned above (optionally, against and in contact with) at least one shingle 104 of the roof 100. For example, the spacers 10 can be coupled to an existing roof (optionally, a shingle roof) via fasteners (e.g., nails), and the roofing material 102 can be coupled to the spacers via fasteners (e.g., nails). In other aspects, the spacers 10 can be used with a new roof. For example, the spacers 10 can be positioned on or above sheathing (e.g., plywood decking).

In exemplary aspects, the roof 100 can comprise a plurality of spacers (or segments of spacers) that are arranged end-to-end to extend across the roof to form a row of spacers.

Optionally, one or more spacers 10 can be cut to length in order to form a row of spacer(s) having a desired length. In further aspects, a plurality of spacers 10, or rows of spacers, can be spaced from each other along their respective transverse axes 24, as shown in FIG. 5. In exemplary aspects, the rows of spacers can be spaced from each other along their respective transverse axes 24 from about 30 cm (1 foot) to about 91 cm (3 feet) or about 61 cm (2 feet) center-to-center.

The spacer and portions of the spacer disclosed herein can serve ornamental purposes, functional purposes, or both.

Aspects

In view of the described spacer, roof, and methods and variations thereof, herein below are described certain more particularly described aspects of the inventions. These particularly recited aspects should not however be interpreted to have any limiting effect on any different claims containing different or more general teachings described herein, or that the "particular" aspects are somehow limited in some way other than the inherent meanings of the language and formulas literally used therein.

Aspect 1: A spacer comprising:

an elongated body having a first end and a second end that are spaced along a longitudinal axis, wherein the elongated body has a first side and an opposed second side that are spaced along a transverse axis that is perpendicular to the longitudinal axis and a third side and an opposed fourth side that are spaced along a thickness axis that is perpendicular to the longitudinal axis and the transverse axis; and at least one channel that extends into the elongated body from the third side of the elongated body and toward the fourth side of the elongated body, wherein the at least one channel extends along the transverse axis from the first side to the second side of the elongated body, wherein each channel of the at least one channel has:

opposed ends each having a width, and a neck between the opposed ends, wherein the neck is narrower than the width of each of the opposed ends.

Aspect 2: The spacer of aspect 1, further comprising at least one groove that extends into the elongated body from the fourth side of the elongated body and toward the third side of the elongated body, wherein the at least one groove extends along the transverse axis from the first side to the second side of the elongated body.

Aspect 3: The spacer of aspect 2, wherein the at least one channel comprises a plurality of channels, wherein the at least one groove comprises a plurality of grooves, wherein each groove of the plurality of grooves is positioned between respective pairs of channels of the plurality of channels.

Aspect 4: The spacer of aspect 2 or aspect 3, wherein each groove of the at least one groove is V-shaped in cross sections perpendicular to the transverse axis.

Aspect 5: The spacer of any one of aspects 2-4, wherein each groove of the at least one groove has a depth along the thickness axis from about 1/16 inch to about ¼ inch.

Aspect 6: The spacer of any one of the preceding aspects, wherein the elongated body has a thickness, wherein each channel of the at least one channel has a depth along the thickness axis that is about half of the thickness of the elongated body.

Aspect 7: The spacer of any one of the preceding aspects, wherein the width of each of the opposed ends of each channel of the at least one channel is from about ½ inch to about 2 inches.

Aspect 8: The spacer of aspect 7, wherein the width of the opposed ends are equal, wherein the neck has a width that is less than about half of the width of the opposed ends.

Aspect 9: The spacer of any one of the preceding aspects, wherein each channel of the at least one channel has a linearly decreasing width between the opposed ends and the neck.

Aspect 10: The spacer of any one of the preceding aspects, wherein for each channel of the at least one channel, the neck has a length along the transverse axis, wherein, along the length of the neck, the channel has a constant width.

Aspect 11: The spacer of any one of the preceding aspects, wherein each channel of the at least one channel is symmetric about a respective plane that bisects the channel and is parallel to the transverse axis and the thickness axis.

Aspect 12: The spacer of any one of the preceding aspects, wherein the elongated body has a length from about 4 feet to about 12 feet.

Aspect 13: The spacer of any one of the preceding aspects, wherein the elongated body has a width along the transverse axis from about 1.5 inches to about 5 inches.

Aspect 14: The spacer of any one of the preceding aspects, wherein the elongated body has a thickness along the thickness axis from about ½ inch to about 2 inches.

Aspect 15: The spacer of any one of the preceding aspects, wherein the at least one channel comprises a plurality of channels that are spaced from each other along the longitudinal axis.

Aspect 16: A spacer comprising:

an elongated body having a first end and a second end that are spaced along a longitudinal axis, wherein the elongated body has a first side and an opposed second side that are spaced along a transverse axis that is perpendicular to the longitudinal axis, and a third side and an opposed fourth side that are spaced along a thickness axis that is perpendicular to the longitudinal axis and the transverse axis;

at least one channel that extends into the elongated body from the third side of the elongated body and toward the fourth side of the elongated body, wherein the at least one channel extends along the transverse axis from the first side to the second side of the elongated body; and at least one groove that extends into the elongated body from the fourth side of the elongated body and toward the third side of the elongated body, wherein the at least one groove extends along the transverse axis from the first side to the second side of the elongated body.

Aspect 17: The spacer of aspect 16, wherein each groove of the at least one groove is positioned between respective pairs of channels of the at least one channel.

Aspect 18: The spacer of aspect 16 or aspect 17, wherein each groove of the at least one groove is V-shaped in cross sections perpendicular to the transverse axis.

Aspect 19: The spacer of any one of aspects 16-18, wherein each groove of the at least one groove has a depth along the thickness axis from about 1/16 inch to about 1/4 inch.

Aspect 20: The spacer of any one of aspects 16-19, wherein the at least one channel comprises a plurality of channels that are spaced from each other along the longitudinal axis.

Aspect 21: The spacer of any one of aspects 16-20, wherein the at least one groove comprises a plurality of grooves that are spaced from each other along the longitudinal axis.

Aspect 22: A roof comprising:

a spacer as in any one of the preceding aspects, and a roofing material positioned on the fourth side of the spacer.

Aspect 23: The roof of aspect 19, wherein the roofing material comprises metal.

Aspect 24: The roof of aspect 19 or aspect 20, wherein the spacer is positioned above at least one shingle.

Aspect 25: The roof of any one of aspects 22-24, further comprising at least one fastener that couples the roofing material to the spacer.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. A spacer comprising:

an elongated body having a first end and a second end that are spaced along a longitudinal axis, wherein the elongated body has a first side and an opposed second side that are spaced along a transverse axis that is perpendicular to the longitudinal axis and a third side and an opposed fourth side that are spaced along a thickness axis that is perpendicular to the longitudinal axis and the transverse axis; and at least one channel that extends into the elongated body from the third side of the elongated body and toward the fourth side of the elongated body, wherein the at least one channel extends along the transverse axis continuously from the first side to the second side of the elongated body, wherein each channel of the at least one channel has:

opposed ends each having a width, and a neck between the opposed ends, wherein the neck is narrower than the width of each of the opposed ends.

2. The spacer of claim 1, further comprising at least one groove that extends into the elongated body from the fourth side of the elongated body and toward the third side of the elongated body, wherein the at least one groove extends along the transverse axis from the first side to the second side of the elongated body.

3. The spacer of claim 2, wherein the at least one channel comprises a plurality of channels, wherein the at least one groove comprises a plurality of grooves, wherein each groove of the plurality of grooves is positioned between respective pairs of channels of the plurality of channels.

4. The spacer of claim 2, wherein each groove of the at least one groove is V-shaped in cross sections perpendicular to the transverse axis.

5. The spacer of claim 1, wherein each groove of the at least one groove has a depth along the thickness axis from about 1/16 inch to about 1/4 inch.

6. The spacer of claim 1, wherein the elongated body has a thickness, wherein each channel of the at least one channel has a depth along the thickness axis that is about half of the thickness of the elongated body.

7. The spacer of claim 1, wherein each channel of the at least one channel has a linearly decreasing width between the opposed ends and the neck.

8. The spacer of claim 1, wherein each channel of the at least one channel is symmetric about a respective plane that bisects the channel and is parallel to the transverse axis and the thickness axis.

9. The spacer claim 1, wherein the elongated body has a length from about 4 feet to about 12 feet.

10. The spacer of claim 1, wherein the elongated body has a width along the transverse axis from about 1.5 inches to about 5 inches.

11. The spacer of claim 1, wherein the at least one channel comprises a plurality of channels that are spaced from each other along the longitudinal axis.

12. A roof comprising:

a spacer as in claim 1, and a roofing material positioned on the fourth side of the spacer.

13. The spacer of claim 1, wherein each channel of the at least one channel comprises:

a surface recessed from the third side; and an opening at the fourth side, opposite the surface recessed from the third side.

14. The spacer of claim 1, wherein the third and fourth sides comprise planar surfaces extending continuously between the first and second sides.

15. A spacer comprising:

an elongated body having a first end and a second end that are spaced along a longitudinal axis, wherein the elongated body has a first side and an opposed second side that are spaced along a transverse axis that is perpendicular to the longitudinal axis, and a third side and an opposed fourth side that are spaced along a thickness axis that is perpendicular to the longitudinal axis and the transverse axis;

at least one channel that extends into the elongated body from the third side of the elongated body and toward the fourth side of the elongated body, wherein the at least one channel extends along the transverse axis continuously from the first side to the second side of the elongated body; and at least one groove that extends into the elongated body from the fourth side of the elongated body and toward the third side of the elongated body, wherein the at least one groove extends along the transverse axis continuously from the first side to the second side of the elongated body.

16. The spacer of claim 15, wherein each groove of the at least one groove is positioned between respective pairs of channels of the at least one channel.

17. The spacer of claim 15, wherein each groove of the at least one groove has a depth along the thickness axis from about 1/16 inch to about 1/4 inch.

18. The spacer of claim 15, wherein the at least one channel comprises a plurality of channels that are spaced from each other along the longitudinal axis.

19. The spacer of claim 15, wherein the at least one groove comprises a plurality of grooves that are spaced from each other along the longitudinal axis.

20. The spacer of claim 15, wherein the third and fourth sides comprise planar surfaces extending continuously between the first and second sides.

* * * * *